US010988218B2

(12) United States Patent
Wei et al.

(10) Patent No.: US 10,988,218 B2
(45) Date of Patent: Apr. 27, 2021

(54) REMOTELY OPERATED UNDERWATER VEHICLE AND CONTROL METHOD THEREFOR

(71) Applicant: Tianjin Deepfar Ocean Technology Co., Ltd., Tianjin (CN)

(72) Inventors: Jiancang Wei, Tianjin (CN); Gangqiao Deng, Tianjin (CN)

(73) Assignee: Tianjin Deepfar Ocean Technology Co., Ltd., Tianjin (CN)

( * ) Notice: Subject to any disclaimer, the term of this patent is extended or adjusted under 35 U.S.C. 154(b) by 0 days.

(21) Appl. No.: 16/483,742

(22) PCT Filed: Oct. 29, 2018

(86) PCT No.: PCT/CN2018/112476
§ 371 (c)(1),
(2) Date: Aug. 5, 2019

(87) PCT Pub. No.: WO2019/128447
PCT Pub. Date: Jul. 4, 2019

(65) Prior Publication Data

US 2020/0189703 A1 Jun. 18, 2020

(30) Foreign Application Priority Data

Dec. 26, 2017 (CN) ..... 201711437234.2
Dec. 26, 2017 (CN) ..... 201721850732.5

(51) Int. Cl.
*B63G 8/00* (2006.01)
*B63C 11/02* (2006.01)

(52) U.S. Cl.
CPC ..... *B63G 8/001* (2013.01); *B63C 11/02* (2013.01); *B63G 2008/005* (2013.01)

(58) Field of Classification Search
CPC ..... B63C 11/00; B63C 11/46; B63C 11/02; B63C 11/48; B63G 8/00; B63G 8/001;
(Continued)

(56) References Cited

U.S. PATENT DOCUMENTS 10,227,117 B2 * 3/2019 Easterling ..... B63G 8/001
10,279,878 B2 5/2019 Sakaue et al.
(Continued)

FOREIGN PATENT DOCUMENTS

CN 102682589 A 9/2012
CN 103677246 A 3/2014
(Continued)

OTHER PUBLICATIONS

International Search Report with English translation, dated Jan. 22, 2019, pp. 1-4, issued in International Application No. PCT/CN2018/112476, National Intellectual Property Association, Peoples' Republic of China, Beijing, China.

*Primary Examiner* — Lars A Olson
(74) *Attorney, Agent, or Firm* — Brinks Gilson & Lione

(57) ABSTRACT

The present disclosure relates to a remotely operated underwater vehicle and a control method therefor. The remotely operated underwater vehicle comprises a body having an imaging unit and a control unit; a power unit disposed on the body; a beacon unit for being worn on a part of a user's body, wherein the beacon unit can emit a plurality of optical control signals with different brightness; and the control unit can control the power unit to respond according to the optical control signals collected by the imaging unit to adjust an action and a posture of the body.

9 Claims, 4 Drawing Sheets

(58) Field of Classification Search
CPC .. B63G 2008/005; G08C 23/00; G08C 23/04; H04N 5/00; H04N 5/44; H04B 10/00
USPC ..... 114/312, 331
See application file for complete search history.

(56) References Cited

U.S. PATENT DOCUMENTS

| | | | |
|---|---|---|---|
| 2014/0078040 | A1 | 3/2014 | Hsieh et al. |
| 2015/0010309 | A1 | 1/2015 | Li et al. |
| 2017/0253313 | A1 | 9/2017 | Easterling |
| 2018/0319473 | A1 | 11/2018 | Sakaue et al. |
| 2019/0121370 | A1 | 4/2019 | Sakaue et al. |
| 2020/0148386 | A1 | 5/2020 | Kuhara et al. |

FOREIGN PATENT DOCUMENTS

| | | | |
|---|---|---|---|
| CN | 104157127 | A | 11/2014 |
| CN | 104464263 | A | 3/2015 |
| CN | 105947150 | A | 9/2016 |
| CN | 106549709 | A | 3/2017 |
| CN | 107085433 | A | 8/2017 |
| CN | 206433061 | U | 8/2017 |
| CN | 206654177 | U | 11/2017 |
| CN | 107498566 | A | 12/2017 |
| CN | 107985533 | A | 5/2018 |
| CN | 207725592 | U | 8/2018 |
| JP | 64-20410 | | 1/1989 |
| JP | 3033027 | U | 10/1996 |
| JP | 2004-56343 | A | 2/2004 |
| JP | 2005-193854 | A | 7/2005 |
| JP | 2017-071266 | A | 4/2017 |
| JP | 201 7-1 781 9 | | 10/2017 |
| WO | WO 2017/061427 | A1 | 4/2017 |

* cited by examiner

REMOTELY OPERATED UNDERWATER VEHICLE AND CONTROL METHOD THEREFOR

FIELD

The present disclosure generally relates to the field of underwater vehicles. In particular, the present disclosure relates to an underwater vehicle using optical communication and a control method therefor.

BACKGROUND

Divers or swimmers usually take pictures when they find beautiful sceneries or commemorative things in the water. Generally speaking, they will carry underwater cameras with them for recording. However, this kind of shooting method cannot completely integrate themselves with the background, and cannot let themselves integrate into the beautiful sceneries. Therefore, they can only rely on their partners to shoot for themselves or rely on underwater cable-controlled robots.

At present, a common remotely operated underwater vehicle (ROV) uses a cable to connect the ROV body and a terminal controller to control ROV movement. This method requires the user to control the ROV through the cable, and the cable is prone to entanglement, knotting, and inconvenient to carry.

SUMMARY

In one aspect, the present disclosure relates to a remotely operated underwater vehicle, comprising:

a body having an imaging unit and a control unit;

a power unit disposed on the body; and a beacon unit for being worn on a part of a user's body, wherein the beacon unit can emit a plurality of optical control signals with different brightness, and the control unit can control the power unit to respond according to the optical control signals collected by the imaging unit to adjust an action and a posture of the body.

In some embodiments of the present disclosure, the beacon unit can transmit a plurality of optical control signals in a flashing manner at different frequencies.

In some embodiments of the present disclosure, a shape formed by a plurality of specific movement trajectories of the beacon unit is preset in the control unit, and a correlation between the shape and a corresponding movement of the body is established; and when the movement trajectory of the beacon unit collected by the imaging unit conforms to the preset shape, the control unit controls the body to complete the corresponding movement.

In some embodiments of the present disclosure, an illuminating light strip is used as the beacon unit. Different light and dark brightness conversions of the light strip are used to switch different optical control signals. Alternatively, the identification of different movement trajectories of the light strip is used as a switching instruction. For example, quick flashing of the light strip is used as an automatic tracking instruction, while slow flashing is used as a spot hovering instruction. This method can clearly distinguish the target from the background, and eliminate the interference of the environment on the optical control signals.

In some embodiments of the present disclosure, a plurality of power units are disposed at different positions on the body; and the control unit can control the corresponding power unit to response according to the optical control signals collected by the imaging unit to adjust an action and a posture of the body.

In some embodiments of the present disclosure, the remotely operated underwater vehicle includes a sensor unit disposed on the body for sensing a diving depth and a hovering posture of the body.

In another aspect, the present disclosure relates to a method for controlling a remotely operated underwater vehicle, comprising:

emitting a plurality of optical control signals with different brightness from a beacon unit worn on a part of a user's body; and controlling a power unit via a control unit disposed on a body of the remotely operated underwater vehicle to respond according to the optical control signals collected by an imaging unit to adjust an action and a posture of the body.

In some embodiments of the present disclosure, the beacon unit can transmit a plurality of optical control signals in a flashing manner at different frequencies.

In some embodiments of the present disclosure, a shape formed by a plurality of specific movement trajectories of the beacon unit is preset in the control unit, and a correlation between the shape and a corresponding movement of the body is established; and when the movement trajectory of the beacon unit collected by the imaging unit conforms to the preset shape, the control unit controls the body to complete the corresponding movement.

In some embodiments of the present disclosure, when the beacon unit transmits an optical control signal of a tracking instruction, and the beacon unit is at a focus position of the imaging unit, the control unit controls the power unit to make a corresponding response such that the body tracks the movement of the beacon unit; and when the beacon unit transmits an optical control signal of a tracking instruction, but the beacon unit is not at a focus position of the imaging unit, the control unit firstly controls the power unit to respond such that the beacon unit is located at the focus position of the imaging unit, and then controls the power unit to respond such that the body tracks the movement of the beacon unit.

In some embodiments of the present disclosure, when the beacon unit transmits an optical control signal of a spot hovering, the control unit can control the power unit to make a corresponding response according to the optical control signal collected by the imaging unit such that the body is spot hovered to a corresponding position; and if the sensor unit senses that an obtained diving depth and a hovering posture of the body and the optical control signal of the spot hovering have an error, the control unit controls the power unit to make a corresponding compensation movement.

DETAILED DESCRIPTION

Figure 1:
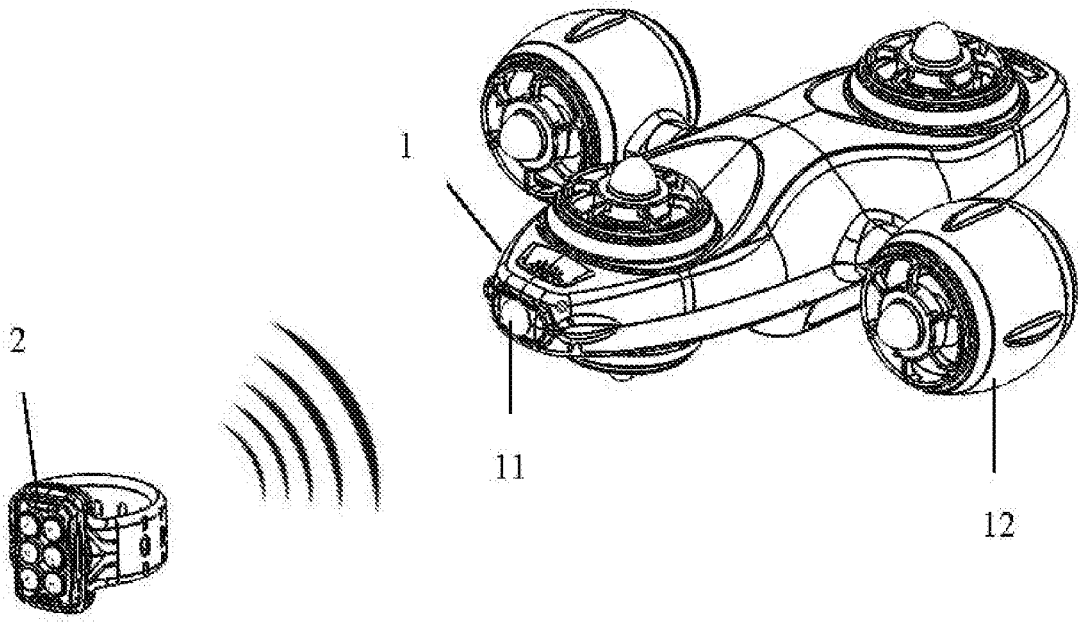
FIG. 1 is a schematic diagram of communication of a remotely operated underwater vehicle in one embodiment of the present disclosure.

In order to make the objects, technical solutions and advantages of the present disclosure clearer, the present disclosure will be further described in detail below with reference to the accompanying drawings and specific examples. While exemplary examples of the present invention have been shown in the drawings, it should be understood that the present disclosure may be implemented in various forms and should not be limited by the examples set forth herein. Rather, these examples are provided so that this disclosure will be more fully understood and the scope of the disclosure may be fully conveyed by those skilled in the art.

As shown in FIG. 1, some embodiments of the present disclosure provide a remotely operated underwater vehicle comprising a body 1 having an imaging unit 11 and a control unit, a power unit 12 disposed on the body, and a beacon unit 2 for being worn on a certain part (such as a wrist) of a user's body.

The beacon unit 2 can transmit a plurality of optical control signals with different brightness. The imaging unit 11 collects the optical control signals and transmits them to the control unit. The control unit controls the power unit 12 to respond according to the optical control signals to adjust an action and a posture of the body 1.

The beacon unit 2 can also transmit a plurality of optical control signals in a flashing manner at different frequencies.

In some embodiments of the present disclosure, a shape (for example, a triangular trajectory, a circular trajectory, a square trajectory, and the like) formed by a plurality of specific movement trajectories in the beacon unit is preset in the control unit, and a correlation between the shape and a corresponding movement of the body 1 is established. When the movement trajectory of the beacon unit 2 collected by the imaging unit 11 conforms to the preset shape, the control unit controls the power unit 12 such that the body 1 completes the corresponding movement.

A plurality of power units 12 are disposed at different positions on the body 1. In the present embodiment, there are four power units 12, which are vertical propellers disposed at the head end and the tail end of the body 1, respectively, and horizontal propellers disposed on the left and right wings of the body 1, respectively. The control unit can control the corresponding power unit 12 to respond according to the optical control signals collected by the imaging unit 11 (for example, when the left horizontal propeller starts, the body rotates to the right; and when the front vertical propeller starts, the body pitches up) to adjust the action and posture of the body 1.

In some embodiments of the present disclosure, a sensor unit for sensing a diving depth and a hovering posture of the body can also be mounted on the body 1.

Figure 2:
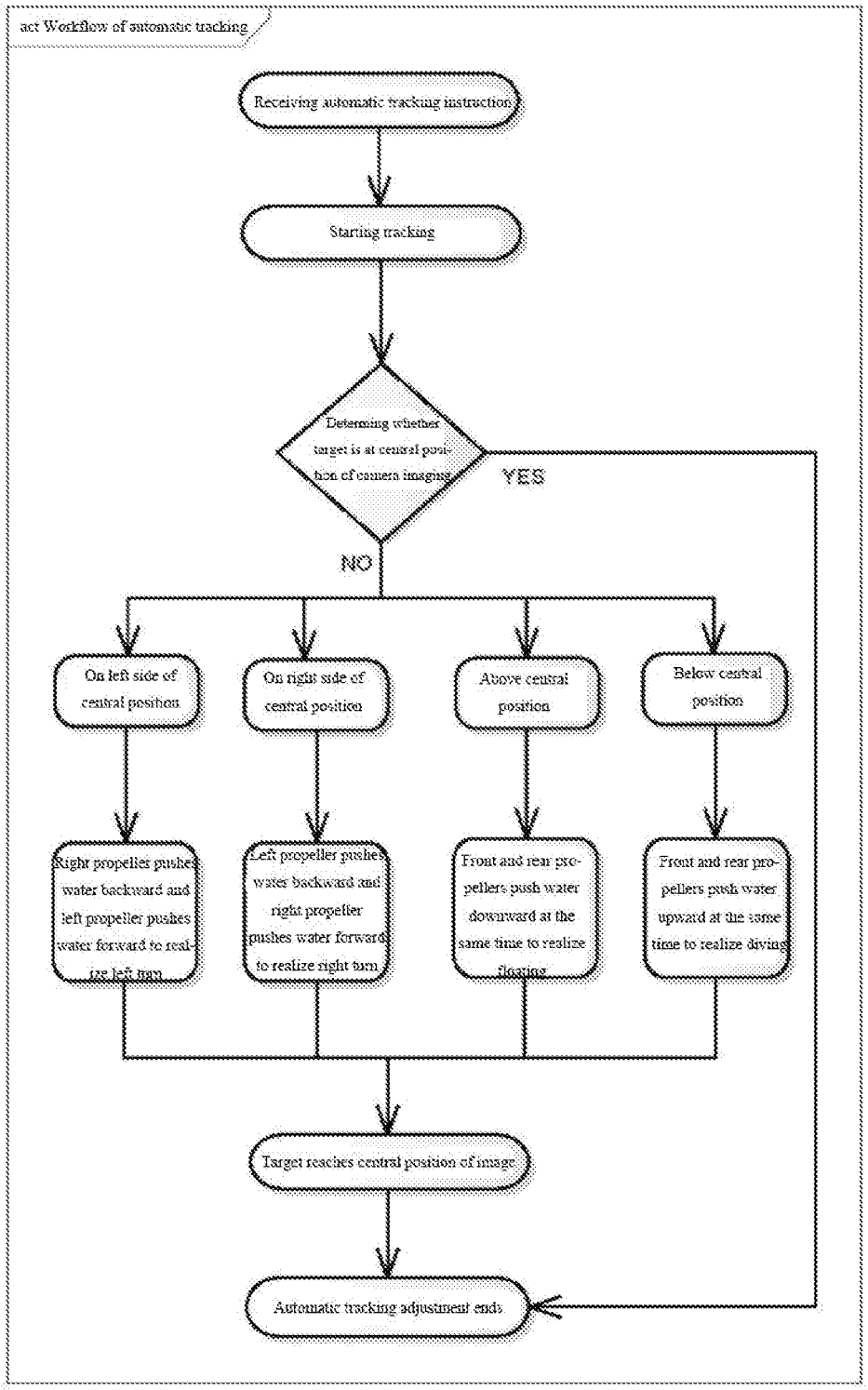
FIG. 2 is a flow chart showing the operation of a remotely operated underwater vehicle according to an automatic tracking control signal in one embodiment of the present disclosure.
Figure 3:
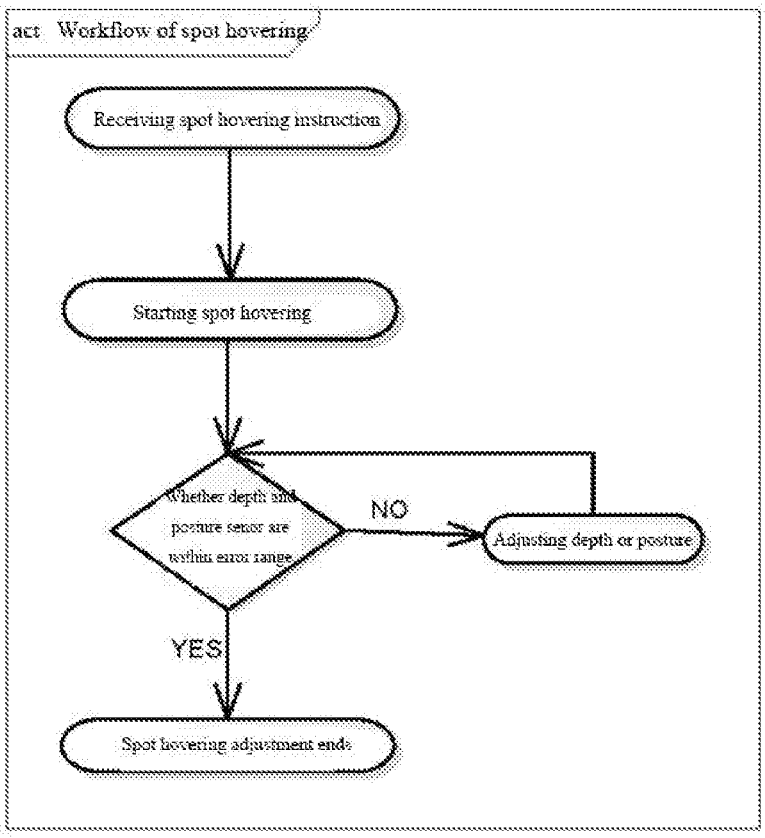
FIG. 3 is a flow chart showing the operation of a remotely operated underwater vehicle according to a spot hovering control signal in one embodiment of the present disclosure.
Figure 4:
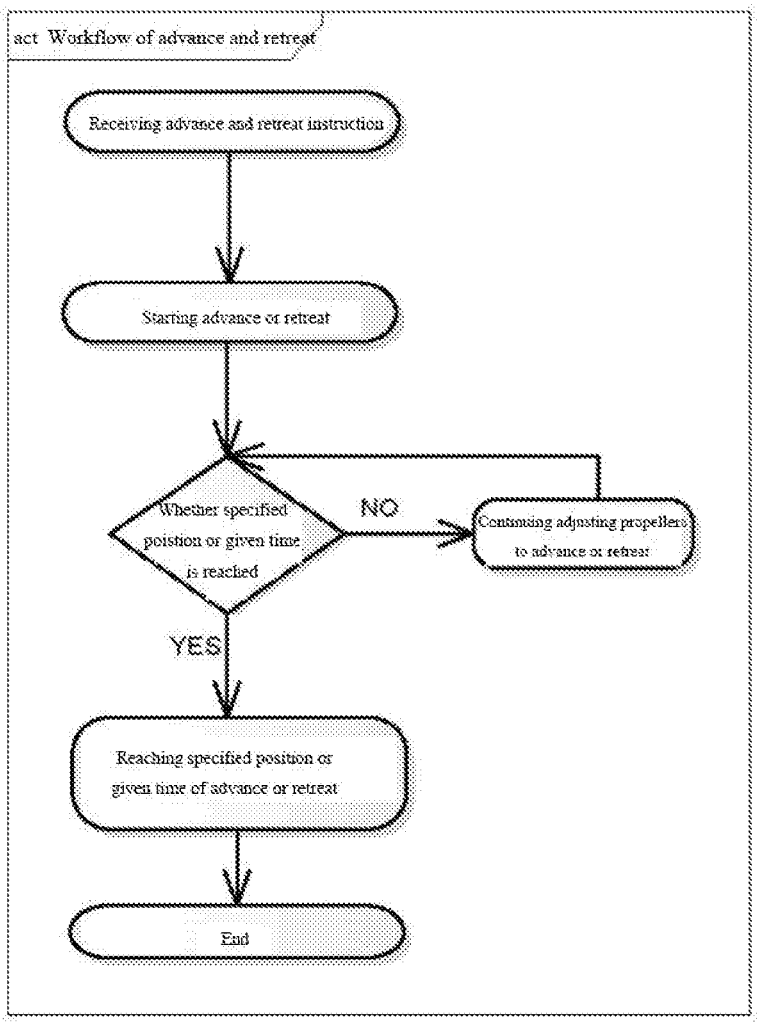
FIG. 4 is a flow chart showing the operation of a remotely operated underwater vehicle according to advancing and retreating control signals in one embodiment of the present disclosure.

As shown in FIGS. 2-4, the present disclosure also provides a method for controlling a remotely operated underwater vehicle, including:

emitting a plurality of optical control signals with different brightness from a beacon unit 2 worn on a part of a user's body; and controlling a power unit 12 via a control unit disposed on the remotely operated underwater vehicle body 1 to respond according to the optical control signals collected by the imaging unit 11 to adjust an action and a posture of the body.

The beacon unit 2 can transmit a plurality of optical control signals in a flashing manner at different frequencies.

In some embodiments of the present disclosure, a shape of a plurality of specific movement trajectories of the beacon unit 2 is preset in the control unit, and a correlation between the shape and a corresponding movement of the body is established. When the movement trajectory of the beacon unit 2 collected by the imaging unit 11 conforms to the preset shape, the control unit controls the body 1 to complete the corresponding movement.

When the beacon unit 2 transmits an optical control signal of a tracking instruction, and the beacon unit 2 is at a focus position of the imaging unit 11, the control unit controls the power unit 12 to make a corresponding response such that the body 1 tracks the movement of the beacon unit 2. When the beacon unit 2 transmits an optical control signal of a tracking instruction, but the beacon unit 2 is not at the focus position of the imaging unit 11, the control unit firstly controls the power unit 12 to make a corresponding response such that the beacon unit 2 is located in the focus position of the imaging unit 11, and then controls the power unit 12 to respond such that the body 1 tracks the movement of the beacon unit.

Referring to FIG. 2, specifically, the control unit receives an optical control signal to start a tracking program. Firstly, the control unit determines whether the beacon unit 2 is at a central position of the imaging unit 11. If the beacon unit 2 is on the left side of the central position, the right propeller pushes the water backward and the left propeller pushes the water forward to realize a fast left turn such that the beacon unit 2 is located at the center of the imaging unit 11. If the beacon unit 2 is on the right side of the central position, the left propeller pushes the water backward and the right propeller pushes the water forward to realize a fast right turn such that the beacon unit 2 is located at the central position of the imaging unit 11. If the beacon unit 2 is above the central position, the front and rear propellers push the water downward to achieve a rapid floating such that the beacon unit 2 is located at the center of the imaging unit 11. If the beacon unit 2 is below the central position, the front and rear propellers push the water upward to achieve a rapid diving such that the beacon unit 2 is located at the center of the imaging unit 11.

Referring to FIG. 3, when the beacon unit 2 transmits an optical control signal of a spot hovering, the control unit 12 can control the power unit 12 to respond according to the optical control signal collected by the imaging unit 11 such that the body 1 is spot hovered to a corresponding location. At this moment, if the sensor unit senses that the obtained diving depth and the hovering posture of the body have an error with the optical control signal of the spot hovering, the control unit controls the power unit 12 to make a corresponding compensation movement.

Referring to FIG. 4, when the beacon unit 2 transmits an optical control signal of advance or retreat, the control unit controls the power unit 12 to push the body 1 forward or backward by a corresponding distance or time. If there is an error in the distance or time of advance or retreat, the control unit controls the power unit 12 to make a corresponding compensation movement.

The remotely operated underwater vehicle and the control method therefor provided by the present disclosure can perform corresponding actions by receiving an optical control signal transmitted from the outside, and realize functions such as spot hovering, automatic tracking, floating, diving, looking down, looking up, turning left, turning right, advancing and retreating to avoid the phenomenon of entanglement when using cable control. At the same time, the remotely operated underwater vehicle has multiple expandable interfaces for carrying underwater cameras, underwater lights, lasers, infrared and acoustic equipment.

At last, it should be noted that the above examples are only used to illustrate the technical solutions of the present disclosure and are not limiting. While the present disclosure has been described in detail with reference to the examples, it should be understood by those skilled in the art that modifications or equivalent replacements made to the technical solutions of the present disclosure shall not depart from the spirit and scope of the technical solution of the present disclosure and all fall within the scope of the appended claims of the present disclosure.

What is claimed is:

1. A remotely operated underwater vehicle, comprising:

a body having an imaging unit and a control unit;

a power unit disposed on the body; and a beacon unit for being worn on a part of a user's body, wherein the beacon unit can emit a plurality of optical control signals with different brightness, and the control unit can control the power unit to respond according to the optical control signals collected by the imaging unit to adjust an action and a posture of the body, wherein a shape formed by a plurality of specific movement trajectories of the beacon unit is preset in the control unit, and a correlation between the shape and a corresponding movement of the body is established; and when the movement trajectory of the beacon unit collected by the imaging unit conforms to the preset shape, the control unit controls the body to complete the corresponding movement.

2. The remotely operated underwater vehicle of claim 1, wherein the beacon unit can transmit a plurality of optical control signals in a flashing manner at different frequencies.

3. The remotely operated underwater vehicle of claim 1, wherein a plurality of power units are disposed at different locations on the body; and the control unit can control the corresponding power unit to respond according to the optical control signals collected by the imaging unit to adjust an action and a posture of the body.

4. The remotely operated underwater vehicle of claim 1, comprising a sensor unit disposed on the body for sensing a diving depth and a hovering posture of the body.

5. A method for controlling a remotely operated underwater vehicle, comprising emitting a plurality of optical control signals with different brightness from a beacon unit worn on a part of a user's body; and controlling a power unit via a control unit disposed on a body of the remotely operated underwater vehicle to respond according to the optical control signals collected by an imaging unit to adjust an action and a posture of the body, wherein a shape formed by a plurality of specific movement trajectories of the beacon unit is preset in the control unit, and a correlation between the shape and a corresponding movement of the body is established; and when the movement trajectory of the beacon unit collected by the imaging unit conforms to the preset shape, the control unit controls the body to complete the corresponding movement.

6. The method for controlling a remotely operated underwater vehicle of claim 5, wherein the beacon unit can transmitting a plurality of optical control signals in a flashing manner at different frequencies.

7. The method for controlling a remotely operated underwater vehicle of claim 5, wherein when the beacon unit transmits an optical control signal of a tracking instruction, and the beacon unit is at a focus position of the imaging unit, the control unit controls the power unit to respond such that the body tracks the movement of the beacon unit; and when the beacon unit transmits an optical control signal of a tracking instruction, but the beacon unit is not at a focus position of the imaging unit, the control unit firstly controls the power unit to respond such that the beacon unit is located at the focus position of the imaging unit, and then controls the power unit to respond such that the body tracks the movement of the beacon unit.

8. The method for controlling a remotely operated underwater vehicle of claim 5, wherein when the beacon unit transmits an optical control signal of a spot hovering, the control unit can control the power unit to respond according to the optical control signal collected by the imaging unit such that the body is spot hovered at the corresponding location; and if the sensor unit senses that an obtained diving depth and a hovering posture of the body and the optical control signal of the spot hovering have an error, the control unit controls the power unit to make a corresponding compensation movement.

9. A method for controlling a remotely operated underwater vehicle, comprising emitting a plurality of optical control signals with different brightness from a beacon unit worn on a part of a user's body; and controlling a power unit via a control unit disposed on a body of the remotely operated underwater vehicle to respond according to the optical control signals collected by an imaging unit to adjust an action and a posture of the body, wherein when the beacon unit transmits an optical control signal of a tracking instruction, and the beacon unit is at a focus position of the imaging unit, the control unit controls the power unit to respond such that the body tracks the movement of the beacon unit; and when the beacon unit transmits an optical control signal of a tracking instruction, but the beacon unit is not at a focus position of the imaging unit, the control unit firstly controls the power unit to respond such that the beacon unit is located at the focus position of the imaging unit, and then controls the power unit to respond such that the body tracks the movement of the beacon unit.

* * * * *